US008806993B2

(12) United States Patent
Coffland

(10) Patent No.: US 8,806,993 B2
(45) Date of Patent: Aug. 19, 2014

(54) TORQUE WRENCH

(75) Inventor: Donald W. Coffland, Seattle, WA (US)

(73) Assignee: The Boeing Company, Chicago, IL (US)

( * ) Notice: Subject to any disclaimer, the term of this patent is extended or adjusted under 35 U.S.C. 154(b) by 476 days.

(21) Appl. No.: 12/700,281

(22) Filed: Feb. 4, 2010

(65) Prior Publication Data

US 2011/0185862 A1 Aug. 4, 2011

(51) Int. Cl.
*B25B 23/142* (2006.01)
*B25B 23/159* (2006.01)
*B25B 23/16* (2006.01)

(52) U.S. Cl.
USPC ..... 81/478; 81/177.8

(58) Field of Classification Search
USPC ..... 81/478–183, 479–483, 177.8, 52
See application file for complete search history.

(56) References Cited

U.S. PATENT DOCUMENTS

| | | | | |
|---|---|---|---|---|
| 3,964,351 | A | 6/1976 | Tsuji | |
| 4,732,062 | A * | 3/1988 | Grabovac et al. | 81/483 |
| 6,119,562 | A * | 9/2000 | Jenkins | 81/479 |
| 6,162,053 | A * | 12/2000 | Hollander | 433/141 |
| 2007/0295174 | A1* | 12/2007 | Hsieh | 81/483 |
| 2011/0185863 | A1* | 8/2011 | Hsieh | 81/479 |

FOREIGN PATENT DOCUMENTS

| | | |
|---|---|---|
| DE | 919999 | 11/1954 |
| DE | 925458 | 3/1955 |
| FR | 1028544 | 5/1953 |
| FR | 1034602 | 7/1953 |
| FR | 2584330 | 1/1987 |
| FR | 2584330 A * | 1/1987 |
| WO | WO 02/070208 | 12/2002 |

* cited by examiner

*Primary Examiner* — Bryan R Muller
(74) *Attorney, Agent, or Firm* — The Small Patent Law Group; Dean D. Small

(57) ABSTRACT

A wrench for applying torque to a fastener that may eliminate or reduce variations associated with off-axis torque application and/or application of force on the handle at a location other than the load position.

10 Claims, 9 Drawing Sheets

TORQUE WRENCH

TECHNICAL FIELD

This application generally relates to wrenches, and, more particularly, to a torque wrench which may employ a virtual center of rotation concentric with the axis of a fastener to compensate for inaccuracies associated with forces being applied to the handle of the wrench at locations other than where the force was applied during calibration of the wrench, and which may compensate for inaccuracies associated with the wrench handle being at angles other than substantially ninety degrees to the fastener axis during torque application.

BACKGROUND

Everyday, manufacturers, machinists, welders, and mechanics may use torque wrenches which allow them to measure and apply torque to a fastener so that the fastener may meet proper tension and loading requirements. A more sophisticated method of presetting torque may include a calibrated torque indication mechanism. The most common form may use an over-center or "click" mechanism which may allow the wrench handle to rotate a few degrees in relation to the head of the tool, with a tactile and audible click when the desired torque is attained.

These torque wrenches may be typically affected by hand-hold position errors. These inaccuracies may be caused by application of force on the handle at locations other than at its centerline, which may affect the bending moment in the handle differently than the torque applied to the fastener. These, inaccuracies may increase in severity when the applied force approaches the wrench click pivot, or as the click pivot is moved farther away from the fastener axis. This design issue may particularly affect tubing torque wrenches where the click or breakaway axis may be significantly offset from the fastener due to physical constraints. The magnitude of these inaccuracies may be as high as 300% based on tool configurations currently in use in industry.

Current click-type torque wrenches may come in two primary configurations: A square drive or ratchet end, and a configuration allowing for the attachment of interchangeable wrench heads. The square drive configuration may be used most commonly with drive sockets, adapters and/or extensions. Interchangeable wrench heads may allow straight-on access to the fastener and utilization of specialty heads for limited access applications. Both configurations may allow for rotation of the wrench handle in a plane substantially normal to the fastener axis of rotation. Correction factors may be necessary with some adapters to maintain application of the proper torque. Universals may be used in line with the drive socket for certain circumstances at up to a 15 degree angle. When it is not possible to access a fastener with a calibrated torque wrench due to the restrictions cited above, there is also a "Two Flats Method" that may be used. This method may require the mechanic to rotate a tube B-nut a prescribed angle, commonly 120 degrees, past hand tight.

The accuracy of existing solutions may depend on the mechanic to apply force at a particular point on the handle, commonly called the "load point". The load point is the location at which the force was applied during calibration of the tool. As noted earlier, applying force at a location other than the load point may result in decreased accuracy of the applied torque. Applying force at the load point is difficult to consistently achieve in practice, due to many factors such as limited access, training, fatigue, etc. Some solutions may incorporate a torque measurement device in-line with the fastener axis. These systems do not suffer from inaccuracies noted above, but commonly may suffer from fastener access issues. These methods are not applicable to tube torque operations where the axis of the fastener is not available because the tube is in the way. Other existing solutions for lack of right angle access to the fastener such as adapters, extensions and crows feet, may be cumbersome, time consuming and prone to error.

In addition, calibrated torque tools typically cannot be hinged near the head because this often causes the indicated torque to be in error in proportion to the cosine of the angle between the wrench head and handle. This may necessitate rigid wrench designs and right angle access to the fasteners. In many areas this access may not be available, especially in tube installations where a variety of constraints affects fastener orientation. A need therefore exists to provide a wrench that overcomes the above-described limitations.

SUMMARY

A wrench comprising: a lever; a drive structure pivotally coupled to said lever through at least one member; and a calibrated click mechanism holding said lever and said drive structure in a fixed position until a predetermined amount of force is applied to said lever, said force driving torque about a virtual center of rotation, wherein said virtual center of rotation is defined by said at least one member and said calibrated click mechanism or two or more members of said at least one member.

A wrench comprising: a handle; a drive structure having a pivotally mounted head; and a calibrated click mechanism holding said lever and said drive structure in a fixed position until a predetermined amount of force is applied to said lever, said calibrated click mechanism coupled to a translating element allowing adjustments to an angle of said pivotally mounted head.

A torque wrench comprising: a handle; a fastener drive structure; a head; and a torque limiting assembly holding said handle and said drive structure in a fixed position until a predetermined amount of force is applied to said handle, wherein said force drives torque about a virtual center of rotation defined by said head proportional to said force applied and independent of location on said handle.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DESCRIPTION OF THE APPLICATION

Figure 1:
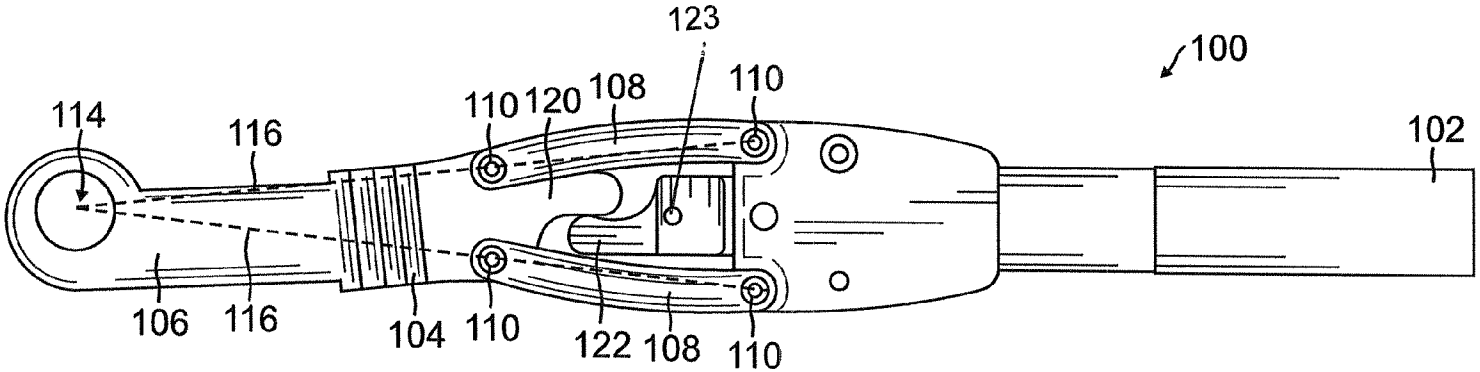
FIG. 1 depicts an exemplary torque wrench in accordance with one embodiment.

The description set forth below in connection with the appended drawings is intended as a description of presently preferred embodiments of the application and is not intended to represent the only forms in which the present application may be constructed and/or utilized. The description sets forth the functions and the sequence of steps for constructing and operating the application in connection with the illustrated embodiments. It is to be understood, however, that the same or equivalent functions and sequences may be accomplished by different embodiments that are also intended to be encompassed within the spirit and scope of this application.

Generally described, the present application relates to a wrench, and more particularly, to a torque wrench that may eliminate or reduce variations associated with torque application. In an illustrative embodiment, the torque wrench may include, but is not limited to, a handle, a fastener drive structure, and a calibrated click mechanism. The fastener drive structure may be pivotally coupled to the handle through at least one member. A single member in conjunction with the calibrated click mechanism may define a virtual center of rotation and may be aligned to the fastener's centerline. In the alternative, a plurality of members may define the virtual center of rotation. Through the calibrated click mechanism, torque may be applied to the fastener through the drive structure using force applied to the handle. The torque may be applied to the virtual center of rotation and may be directly proportional to the force applied to the handle independent of location on the handle. In the same or entirely new embodiment, the calibrated click mechanism may be coupled to a translating element that longitudinally moves when the head is adjusted. In another illustrative embodiment, the head of the wrench can include a bearing assembly that defines a virtual center of rotation.

The previous illustrations are not intended to limit the scope of the present application. Instead, the wrench may come in a variety of embodiments that will become apparent from the discussion provided below. Typically, the wrench may create a virtual center of rotation about a fastener's axis. The virtual center of rotation generally may eliminate torque error even though force is applied at a location other than the load position of the handle. The wrench effectively may separate the applied forces on the handle into those which act to torque the fastener, which are those acting perpendicular to the axis of the fastener, from those which do not apply torque to the fastener, which are off-axis forces.

Through the virtual center of rotation, the wrench described herein may improve its accuracy by typically eliminating the variations induced by applying the torquing force on the handle at a location or angle other than at the load position, where the force was applied when the tool was certified. Furthermore, the wrench may allow the head to be hinged relative to the wrench body and still maintain its required accuracy. The wrench may incorporate an off-axis compensation mechanism which dynamically adjusts the required force to click the wrench based on the angle of the head to the handle, which further maintains accurate torque application to the fastener independent of that wrench angle.

In addition, the wrench incorporates the accuracy of an inline torque measurement system in locations where those systems could not be used due to physical constraints or ease of accessibility. The wrench may also enable the location of the torque measurement device to be placed between the head of the wrench and the handle without reduction in accuracy and thus, providing significant flexibility in wrench design.

With reference now to FIG. 1, an exemplary torque wrench 100 in accordance with one aspect of the present application is presented. In typical embodiments, the wrench 100 may include, but is not limited to, a handle 102, drive structure 104, head 106, members 108, pivot points 110, engagement section for a fastener 114, torque lever 120, and torque application arm 122. A pair of lines 116 may define a virtual center of rotation as shown within FIG. 1. Each of these elements will be discussed in more details below.

As recited, the wrench 100 may include a handle 102. Previously, inaccuracies were caused by application of force on the handle 102 at locations or angles other than at its load position. This often affected the bending moment in the handle 102 differently than the torque applied to the fastener. The handle 102 provided within the present application may be used for delivering torque to a fastener regardless of where the force is applied. The handle 102 may include a tubular shape and typically be straight. One skilled in the relevant art will appreciate, however, that the handle 102 may come in a variety of forms and shapes and should not be limited to the handle 102 shown in FIG. 1.

In one embodiment, the handle 102 may include a rubber attachment. The rubber attachment may allow an operator to grip the handle 102 providing more leverage for the wrench 100. Alternatively, the handle 102 may include etches for grip. In one embodiment, which may or may not be related, the handle 102 may be arced or bent. The handle 102 may be made of steel or other type of sturdy metal. Alternatively, the handle 102 may be made of nylon, plastic, or wood. In another embodiment, the wrench 100 may include double handles 102. In this embodiment, a duplicate set of elements, as described above, may be used. The double handles 102 may be used for turning square fasteners provided for in threading operations.

Generally, the handle 102 may follow an arcuate path around the axis of a fastener. The term handle 102 may refer to the portion where the operator grips or applies force to. The term handle 102 may also refer to the entire back-end portion shown in FIG. 1. The handle 102 may also be referred to as a lever, holder, knob, etc.

Coupled to the handle 102 is the drive structure 104. By using the handle 102 and the drive structure 104, the accuracy of the wrench 100 may be improved by eliminating the variation introduced by applying force on the handle 102 at a location other than the load position. The drive structure 104 generally allows the force applied to the handle 102 to be provided as torque to the fastener. The drive structure 104 may typically be made of similar materials as the handle 102.

Continuing with the wrench 100 provided for in FIG. 1, the drive structure 104, as shown, may be coupled to the head 106. The term head 106 may refer to an element separate from the drive structure 104. The term drive structure 104 may also refer to both the drive structure 104 and the head 106. Alternatively, the term head 106 may refer to the drive structure 104 and the head 106.

The head 106 may extend the length of the wrench 100 so that a virtual center of rotation about a fastener's axis is formed. The head 106 may include an engagement section 114, which may provide a gripping surface for a fastener. The head 106 itself may also be interchangeable to accommodate multiple fasteners. The head 106 may be, but is not limited to, a square drive, flare nut, box, open end, square drive ratchet, hex drive, ratchet flare, nut, ratcheting tube, ratcheting open end, standard tooling adapter, and crowfoot adapter.

The handle 102 may be coupled to the drive structure 104 through a plurality of members 108. The plurality of members 108 may be pivotally connected to the handle 102 and the drive structure 104 at the pivot points 110. In one embodiment, the members 108 may be arced or in the alternative, the members 108 may be straight.

The members 108 may be aligned so that if an imaginary line 116 were drawn through the pivot points 110, the lines would intersect through the center of the engagement section 114, which corresponds with a fastener's axis. Typically, the lines 116 intersect at an acute angle within the engagement section 114. Through the virtual center of rotation generated by the intersection of lines 116, the wrench 100 may remove off-axis torque application.

The force applied to the handle 102 may be applied to the drive structure 104 through a torque lever 120 and torque application arm 122. The torque lever 120 may be coupled to the drive structure 104, while the torque application arm 122 may be coupled to the handle 102. As shown, the torque lever 120 and the torque application arm 122 may have contact with each other. In operation, and in accordance with one embodiment, when force is applied to the handle 102, the force is transferred to the torque application arm 122. The force is then applied to the torque lever 120 at the contact point. The force may be transferred to the drive structure 104. The drive structure 104 transfers the force to the head 106 where the engagement section 114 provides torque to a fastener.

Combined the torque lever 120 and the torque application arm 122, in one embodiment, may be referred to as a calibrated click mechanism 123. The torque lever 120 and the torque application arm 122 may also generally be described as one form of a detent. Detents often retain one part in a certain position relative to another. When enough force is applied, one of the parts may be released. In one example, the detent may hold the handle 102 and the drive structure 104 of the wrench 100 in a fixed position until a predetermined amount of force is applied to the handle 102. The detent may take force applied to the handle 102 and translate that force into torque onto the drive structure 104 and through the head 106 until the predetermined amount of force is reached. The applied force may drive torque about the virtual center of rotation concentric with the fastener's axis.

One skilled in the relevant art will appreciate that there are many types of detents. In one embodiment, the wrench 100 may use a ball detent. The ball detent may be used to hold the handle 102 in a temporary fixed position relative to the drive structure 104. Generally, the handle 102 may slide or rotate with respect to the drive structure 104 using a ball that may include a metal sphere rotating within a cylinder against the pressure of a spring, the spring pushing the ball against a detent. When the detent is in line with the cylinder, the ball falls partially into the hole under spring pressure, holding the parts at that position. Force applied to the moving parts may push the ball back into its cylinder, compressing the spring, and allowing the parts to move to another position.

In typical embodiments, the force acting about the virtual center of the fastener is directly proportional to the torque being applied to the fastener and independent of the location of applied force on the handle. Measuring the force at this point may be achieved by utilizing an existing manual click torque wrench 100, or with load cells 101 (FIG. 5D), strain gages 103 (FIG. 5E), or other methods.

Figure 2:
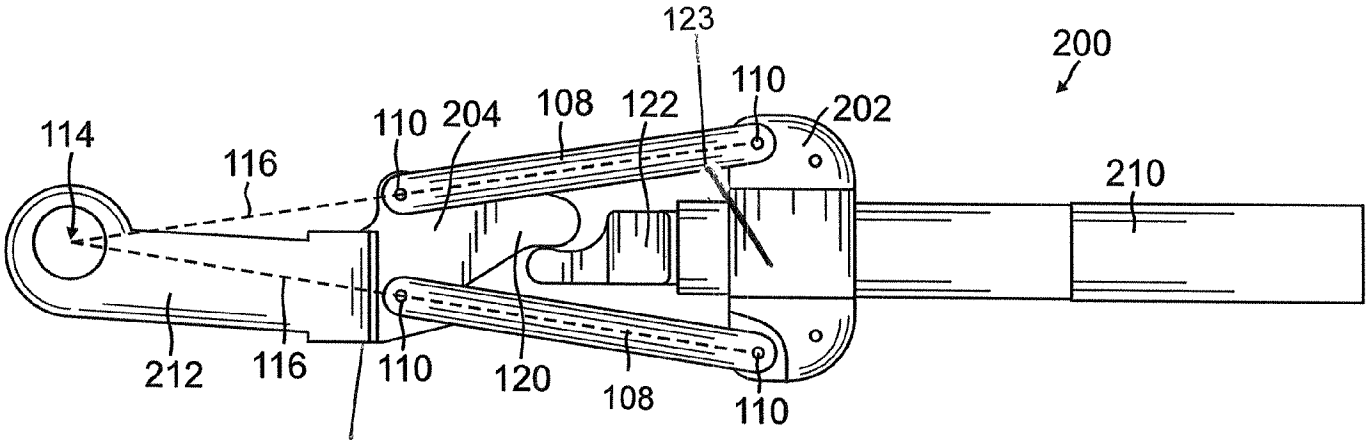
FIG. 2 is a diagram illustrating an alternative torque wrench in accordance with one embodiment.

FIG. 2 is a diagram illustrating an alternative wrench 200 in accordance with one aspect of the present application. In particular, the wrench 200 shows how a standard torque wrench 200 may be converted or transformed into the torque wrench 100 provided above. The standard torque wrench 200 may include a standard tube wrench head 212 as well as a standard handle 210. The standard tube wrench head 212 may include an engagement section 114, which may provide a gripping surface for a fastener.

A wrench adapter 202 for the members 108 may be coupled to the handle 210. As shown, there are two members 108 that are attached. The members 108 may couple the handle 210 to the head 212. The head 212 may also include a head adapter 204, which may be coupled to the members 108. The wrench adapter 202 and the head adapter 204 may align the members 108 so that if an imaginary line 116 were drawn through their pivot points 110, the lines would intersect through the center of the engagement section 114. Typically, the lines 116 intersect at an acute angle within the engagement section 114. Force applied to the handle 210 may be applied to the head 212 through the torque lever 120 and torque application arm 122, as described above. Alternatively, numerous other embodiments for transferring the force from the handle 210 to the head 212 have been shown above.

The torque wrench 100 and the standard torque wrench 200 may come in a variety of different forms and shapes and are not limited to those described above. One skilled in the relevant art will appreciate similar elements are provided in both. As such, the following discussion will relate to the torque wrench 100 provided for in FIG. 1. Nonetheless, the discussion should not be limited to any single embodiment.

Before, a virtual center of rotation was described. By using the virtual center of rotation, the wrench 100 may eliminate torque error caused by applying force at a location other than the load position of the handle 102. Using the virtual center may effectively separate the applied forces on the handle 102 into those which act to torque the fastener, which are those forces acting perpendicular to the axis of the fastener, from those which do not apply torque to the fastener, which are off-axis forces. Through the virtual center of rotation, the torque applied to a fastener is simplified by force times distance.

Figure 7A:
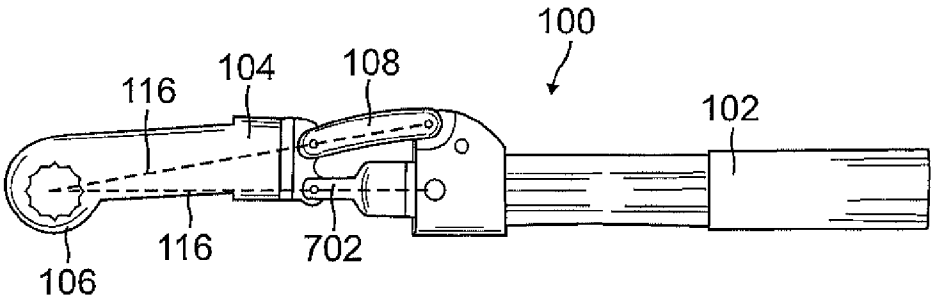
FIG. 7A is a simplified version of the exemplary torque wrench in accordance with one embodiment.
Figure 7B:
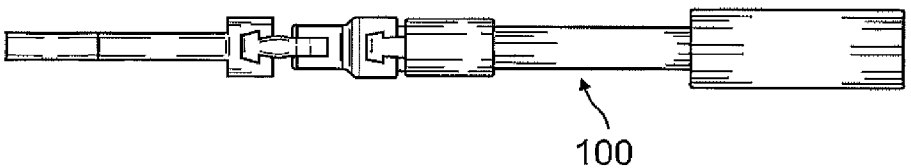
FIG. 7B is a side view thereof.
Figure 7C:
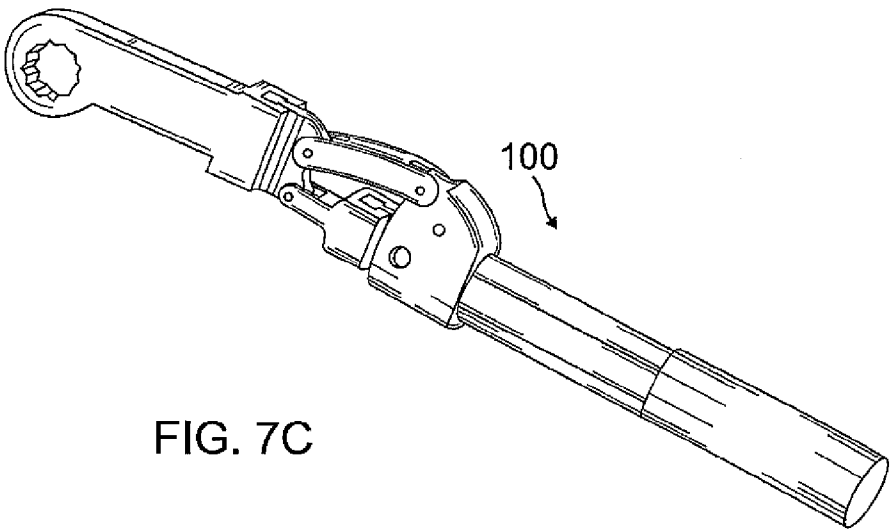
FIG. 7C is a perspective view thereof.
Figure 7D:
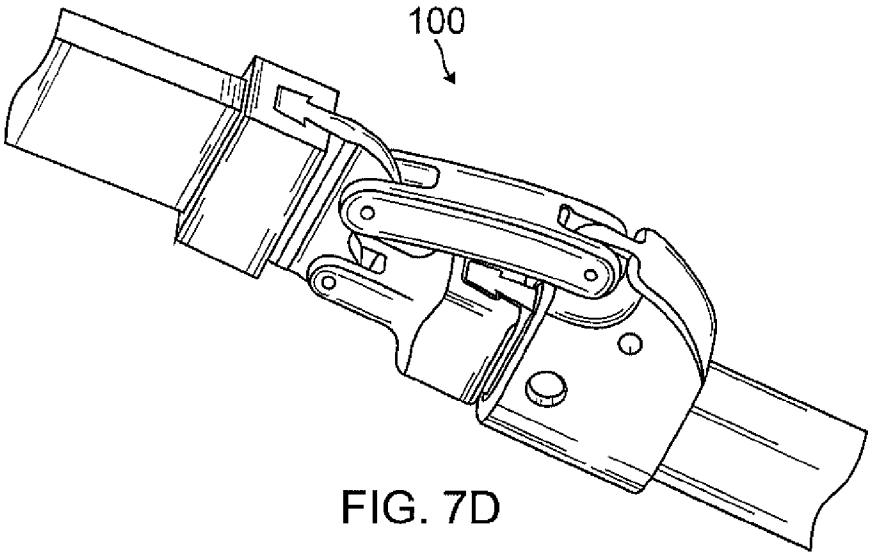
FIG. 7D is a closer view thereof.
Figure 7E:
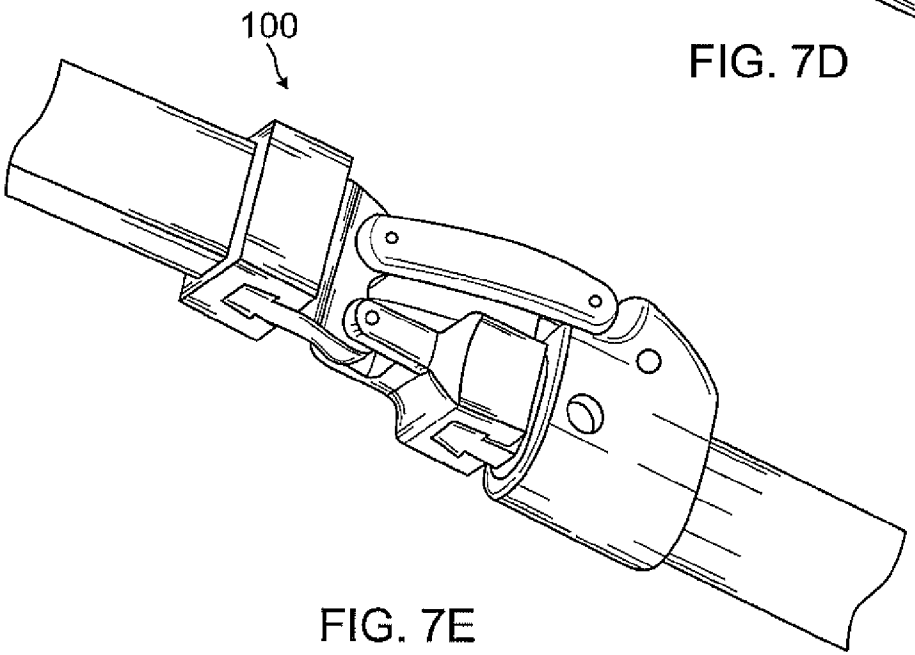
FIG. 7E is a closer view thereof.

Previously, the wrench 100 included at least two members 108 pivotally coupled to the handle 102 and the fastener drive structure 104. As will become apparent, the wrench 100 may include fewer or more members 108. With reference now to FIG. 7A, a single member 108 may be used in combination with the calibrated click mechanism 702. The at least one member 108 may be fixedly mounted to the calibrated click mechanism 702, which as defined earlier may take on the form of a detent, torque lever 120 and torque application arm 122 assembly, etc. The at least one member 108 in combination with the calibrated click mechanism may define a virtual center of rotation and both may be aligned to the fastener's centerline similar to those embodiments provided above. The calibrated click mechanism 702 may hold the drive structure 104 in a fixed position until a predetermined amount of force is applied to the handle 102 with the force driving torque about the virtual center of rotation. The torque may be applied to the virtual center of rotation and may be directly proportional to the force. FIG. 7B is a side view of the exemplary wrench and FIG. 7C is a perspective view thereof. FIGS. 7D and 7E are closer views thereof.

Previously, multiple members 108 were used to define the virtual center of rotation. Imaginary lines 116 were drawn through each of the pivot points 110 to define the virtual center of rotation, the point where the imaginary lines 116 intersected at an acute angle. In FIGS. 7A through 7E, the member 108 along with the calibrated click mechanism 702 may define the virtual center of rotation through the shown imaginary lines 116. Typically, the lines 116 intersect at an acute angle within the engagement section 114. As described, through the virtual center of rotation generated by the intersection of the lines 116, the wrench 100 may remove off-axis torque application.

Figure 3A:
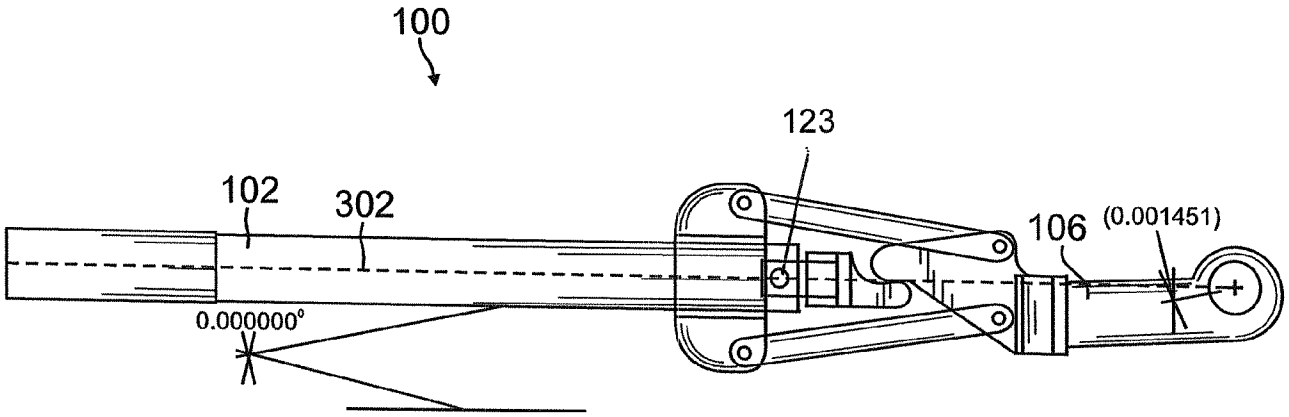
FIG. 3A is the exemplary torque wrench handle pivoted at 0 degrees.
Figure 3B:
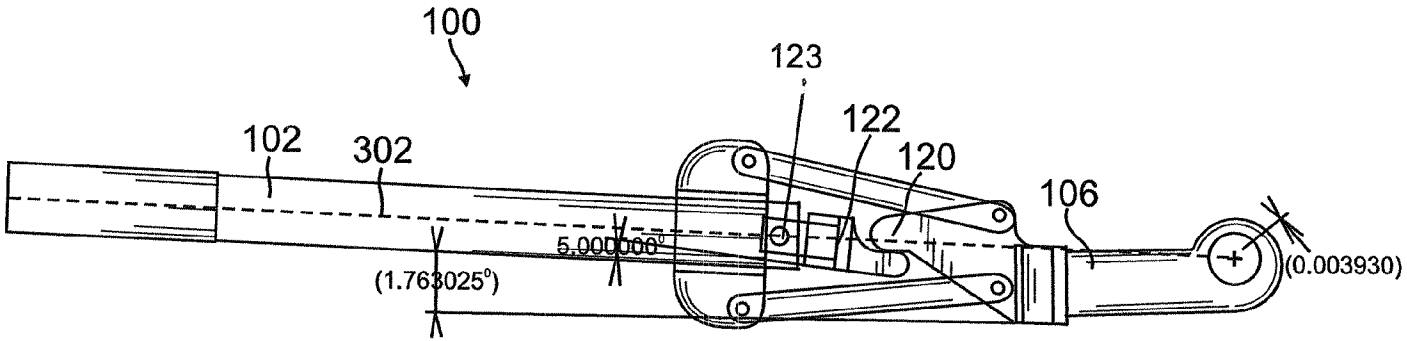
FIG. 3B is the exemplary torque wrench handle pivoted at 1.76 degrees, the point at which the wrench click mechanism lever arm typically pivots 5 degrees and has clicked.

With reference now to FIGS. 3A and 3B, the torque wrench 100 is pivoted at multiple angles to further illustrate the virtual center of rotation. The dashed centerline 302 down the center of the handle 102 points to the virtual center of rotation. The difference between the actual center of the fastener and the virtual center is indicated within parenthesis near the head 106. Generally, the distance between the virtual center and the actual center of the fastener may determine the amount of error generated by the wrench 100.

FIG. 3A shows the torque wrench 100 having its handle 102 pivoted at 0 degrees. As shown, the virtual center of rotation may be differentiated from the true fastener center of the wrench 100 by 0.001451 inches. Because the difference is small or negligible, the force applied to the handle 102 may mostly be provided as torque to the fastener. FIG. 3B depicts the torque wrench 100 pivoted at 1.763025 degrees. As shown, the torque application arm 122 and the torque lever 120 has been deflected 5.000000 degrees. The virtual center of rotation may be differentiated from the true fastener center by 0.003930 inches. In this embodiment, this may cause a "click" sound.

Figure 4:
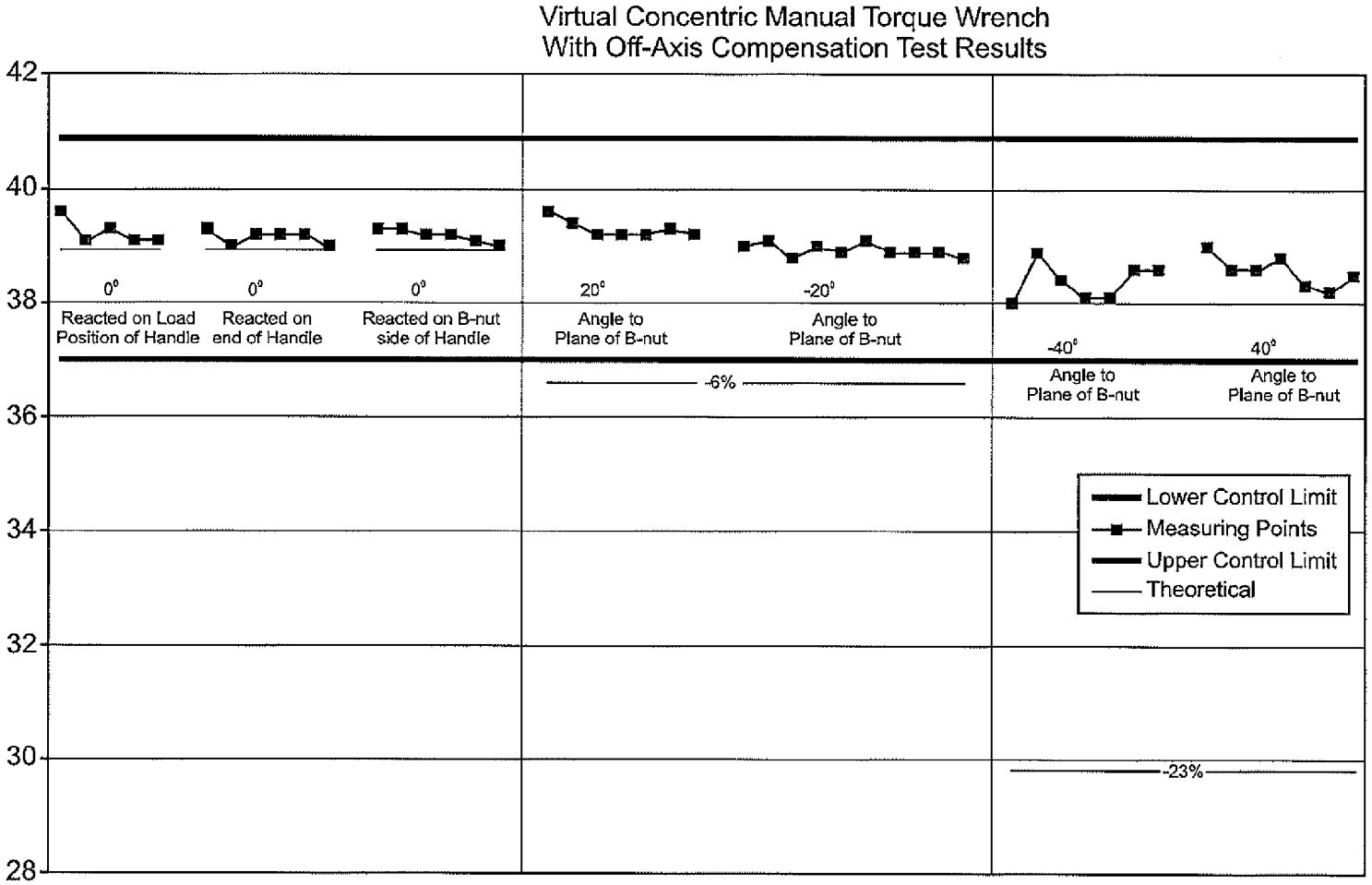
FIG. 4 is an illustrative graph showing test results of the exemplary torque wrench in accordance with one embodiment.

FIG. 4 is an illustrative graph showing test results of the exemplary torque wrench 100 in accordance with one aspect of the present application. The test results show applying force at the load position of the handle 102, at the end of the handle 102, and on the B-nut side of the handle 102, which is the metal part of the handle 102. Furthermore, the graph shows applying force at the load position of the handle 102 with the wrench 100 at 0, 20, and 40 degrees off-axis. The theoretical results are what would be expected of a standard click wrench 100 at that angle.

The exemplary wrench 100 and test results provided above were for illustrative purposes. The numerical values associated with the wrench 100 should not be construed as limiting the scope of the present application, but instead be used to understand the virtual center of rotation. One skilled in the relevant art will also appreciate that the values may change. Furthermore, the angle at which the wrench 100 looses contact may vary.

Figure 5A:
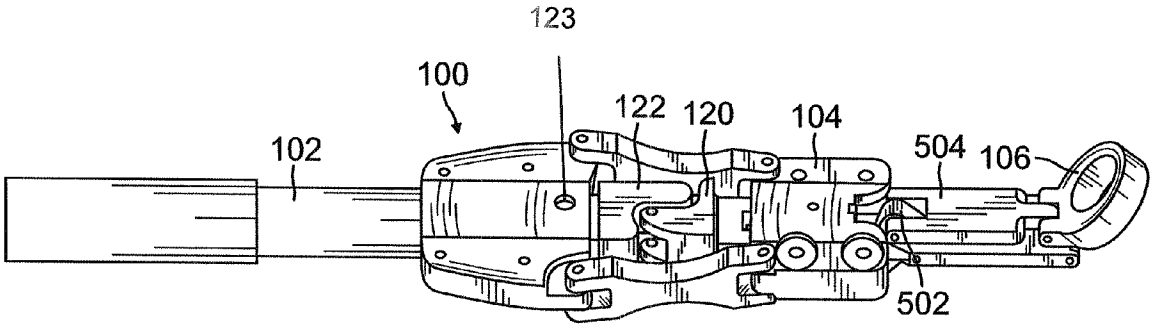
FIG. 5A shows the exemplary torque wrench in an illustrative position with its torque lever extended and its head pointed upwards in accordance with one embodiment.
Figure 5B:
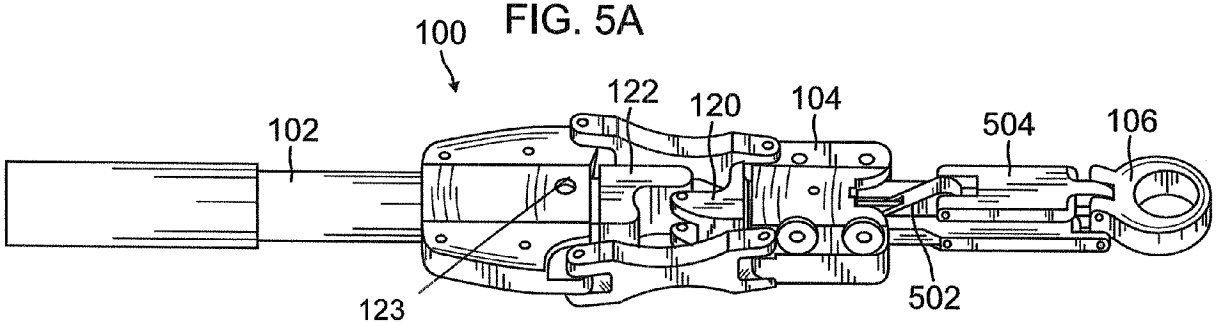
FIG. 5B provides the exemplary torque wrench in an illustrative position with its torque lever shortened and its head relatively flat.
Figure 5C:
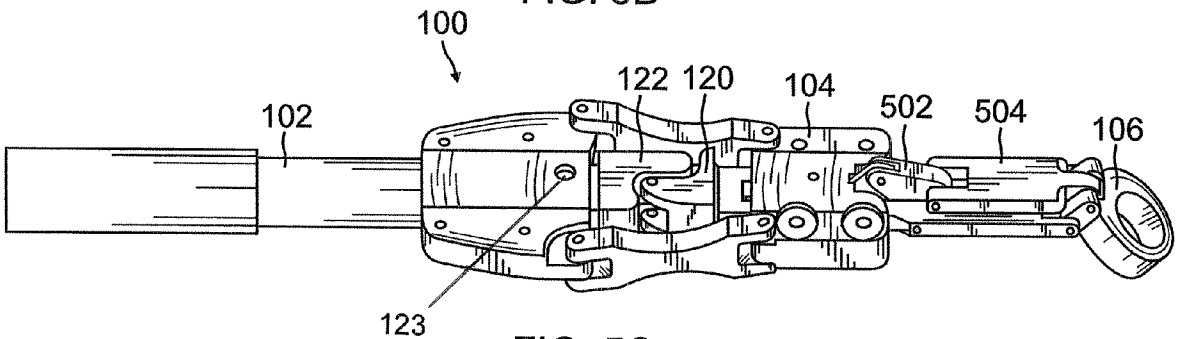
FIG. 5C diagrams the exemplary torque wrench in an illustrative position with its torque lever extended and its head pointed downwards.
Figure 5D:
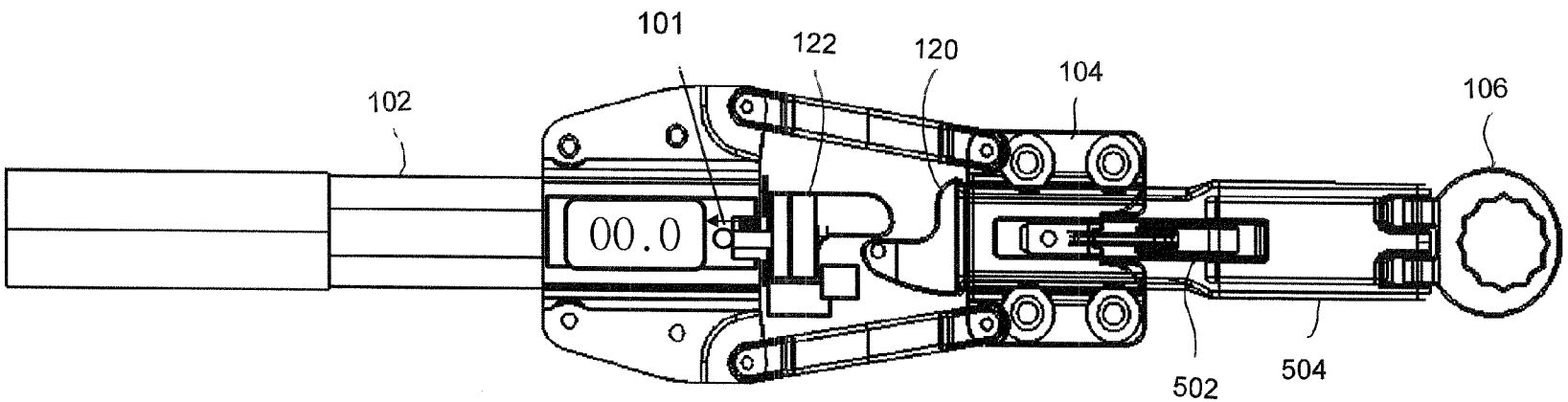
FIG. 5D shows the exemplary torque wrench having a load cell.
Figure 5E:
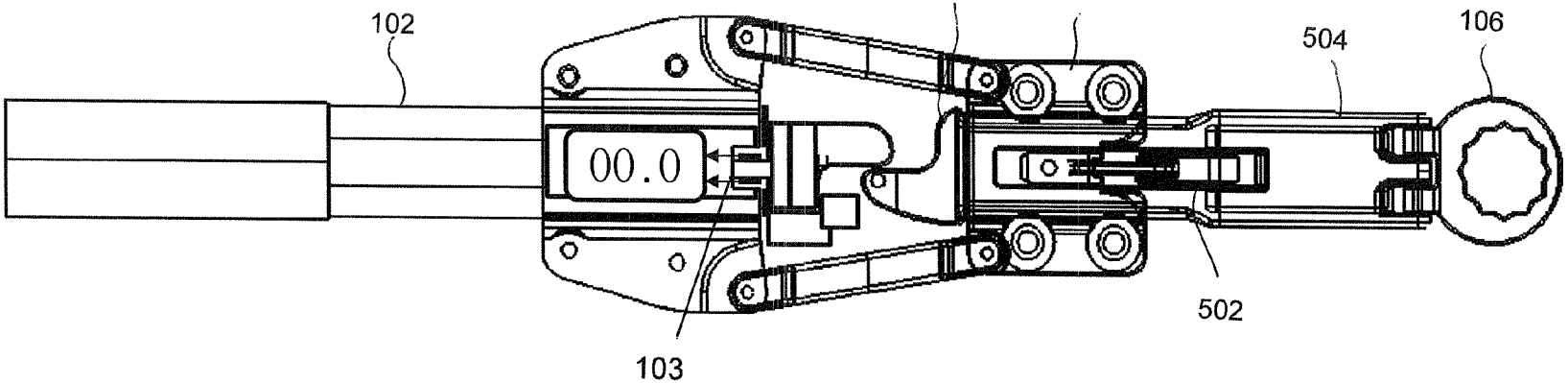
FIG. 5E shows the exemplary torque wrench having strain gauges.

The virtual center may also be used for dynamic force adjustment to compensate for angles other than 90 degrees to the fastener's axis. When a wrench 100 is utilized at these "off-axis" angles, the amount of force that may be applied to the handle 102 increases to compensate for forces that do not contribute torque application. The wrench 100 may automatically adjust the force required to achieve the proper torque on the fastener using an off-axis capability. In particular, the head 106 of the wrench 100 may be pivotally mounted so that it may be adjusted to different angles as shown in FIGS. 5A through 5C. In one embodiment, this may be achieved by using a translating element 502. In operation, the angle of the head 106 may be pivoted causing the translating element 502 to adjust the point of contact on the torque lever 120 and the torque application arm 122. The translating element 502 may be coupled to a link 504, which may then be coupled to the head 106 of the wrench 100. The translating element 502 along with the link 504 may change the effective torque lever length. Generally, this allows the head 106 to be hinged relative to the wrench body and still maintain the required accuracy.

The term translating element 502 may refer to a separate element. The term may also refer to both the translating element 502 and the link 504. Furthermore, the term may refer to the link 504 itself. The translating element 502 and the link 504 may be referred to others terms known to those skilled in the art.

In the embodiment provided within FIGS. 5A through 5C, the handle 102 may be fixed to the drive structure 104. The torque lever 120 and the torque application arm 122 may contact each other. The torque lever 120 may be coupled to the translating element 502, which may be routed through the drive structure 104. Coupled to the translating element 502 may be link 504, which may be coupled to the head 106.

FIG. 5A shows the exemplary torque wrench 100 in an illustrative position with its torque lever 120 extended and its head 106 pointed upwards in accordance with one aspect of the present application. The head 106 may push the link 504 and the translating element 502 longitudinally to the left. This may cause the torque lever 120 to push to the left as well. As a result, the torque lever 120 may then contact the torque application arm 122 at a point closer to its pivot as shown. This will require a higher force be applied to the handle in order to click the calibrated click mechanism.

FIG. 5B provides the exemplary torque wrench 100 in an illustrative position with its torque lever shortened and its head 106 relatively flat in accordance with one aspect of the present application. As shown, the torque lever 120 and the torque application arm 122 may include a contact point farther from the pivot, thus requiring a lower force be applied to the handle in order to click the calibrated click mechanism. In one embodiment, the head is in a relatively flat position shown. This flat position may cause the link 504 and the translating element 502 to be extended. This may cause the torque lever 120 to be pulled longitudinally to the right through the drive structure 104.

FIG. 5C diagrams the exemplary torque wrench 100 in an illustrative position with its torque lever 120 extended and its head 106 pointed downwards in accordance with one aspect of the present application. The torque lever 120 may contact the torque application arm 122 at a point closer to the pivot, thus requiring a higher force on the handle to click the calibrated click mechanism. The head 106 may pivot in a downwards motion. This may cause the link 504 and translating element 502 to be pulled to the right which may cause the torque lever 120 to be pushed to the left making contact with the torque application arm 122 closer to the pivot.

As the head 106 of the wrench 100 pivots, the translating element 502 and the link 504 may move longitudinally, which varies the torque lever length. Generally, the link 504 may cause the translating element 502 to move in proportion to the cosine of the angle between the head 106 and the handle 102. The distance from the pivot point of the detent may be dynamically adjusted based on the angle of the head 106 allowing the torque on the fastener to be maintained independently of the wrench angle to the fastener. Utilizing the link 504 and the translating element 502, the virtual center of the wrench to the fastener's true centerline may be maintained. This may be achieved using the same linkage mechanism. Typically, the head 106 of the wrench 100 may be adjusted at +/−45 degrees, but greater angles may be possible based on the physical wrench configuration.

Figure 6:
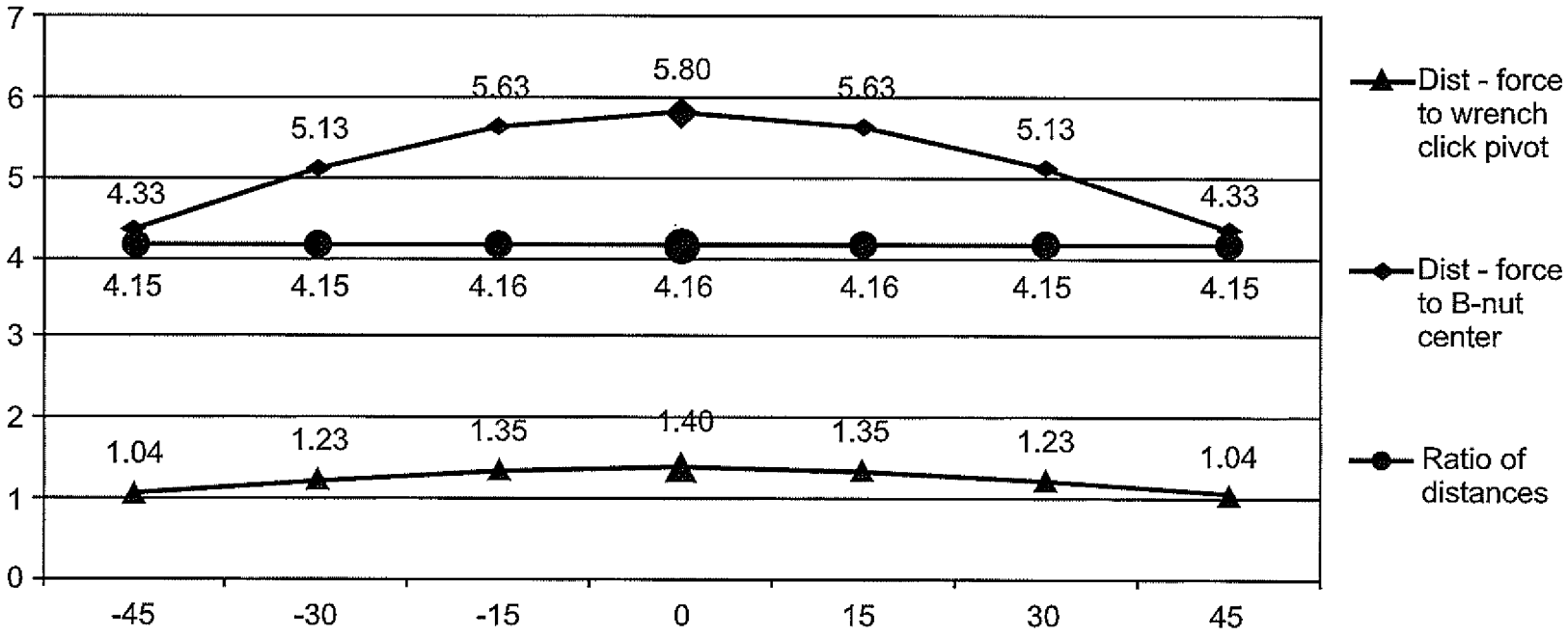
FIG. 6 is an illustrative graph depicting the constant ratio of the torque lever length and the distance from the torquing force to the fastener's centerline in accordance with one embodiment.

FIG. 6 is an illustrative graph depicting the constant ratio of the detent and the distance from the torquing force to the fastener's centerline in accordance with one aspect of the present application. The graph demonstrates how the ratio of the detent to the distance from the torquing force to the fastener centerline may be constant.

By combining both the virtual center of rotation and the off-axis capability, as shown in FIGS. 5A through 5C, the wrench 100 may maintain an accurate torque application to fasteners independent of the user's hand location on the handle angle to the fastener. It may achieve this by creating a virtual center about the fastener centerline when one is not available such as in tubing applications. With this, the torque measurement process is no longer impacted by where the force is applied to the handle 102. The wrench 100 may also become an enabler for dynamic force adjustment to compensate for using the wrench 100 at angles other than 90 degrees to the fastener axis. When a wrench 100 is utilized at these "off-axis" angles, the amount of force that is applied to the handle 102 typically increases to compensate for forces that do not contribute torque application. This wrench 100 may automatically adjust the force used to achieve the proper torque on the fastener.

One skilled in the relevant art will appreciate that the virtual center of rotation and the off-axis capabilities may be combined or be separate embodiments altogether. While distinguishable, the capabilities are related by sharing the same torque lever 120.

Figure 8B:
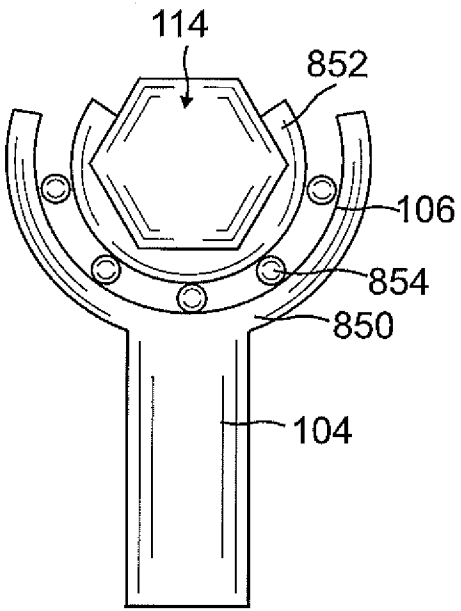
FIG. 8B illustrates an exemplary roller bearing assembly in accordance with one aspect of the present application.
Figure 8A:
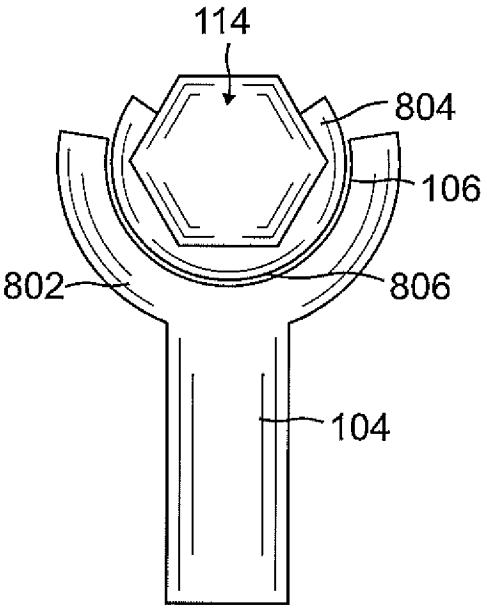
FIG. 8A depicts an exemplary sleeve and journal bearing for providing a virtual center of rotation in accordance with one aspect of the present application.

Beforehand, numerous embodiments were provided for a wrench 100. Furthermore, a virtual center of rotation was described that removed off-axis torque applications. With reference now to FIGS. 8A and 8B, exemplary bearings are shown that may also provide a virtual center of rotation. Those skilled in the relevant art will appreciate that there can be numerous types of bearings for providing a virtual center of rotation within the context of the present application and are not limited to those embodiments described below.

With reference now to FIG. 8A, an exemplary sleeve and journal bearing for providing a virtual center of rotation in accordance with one aspect of the present application is presented. The sleeve and journal bearing typically does not include members 108 nor calibrated clutch mechanisms 702 for defining the virtual center of rotation. Instead, an inner circular portion 804 with an outer circular portion 802 may create the virtual center of rotation. Between the inner circular portion 804 and the outer circular portion 802 may be lubrication 806. The lubrication allows the sleeve and journal bearing to rotate the inner circular portion 804 within the outer circular portion 802. As shown, the virtual center of rotation is defined by the head 106, which may be connected to the drive structure 104 and provide torque to the engagement section 114.

FIG. 8B illustrates an exemplary roller bearing assembly in accordance with one aspect of the present application. As shown, and similar to before, the roller bearing is provided within the head 106 and may be coupled to the drive structure 104. In typical embodiments, the roller bearing may include an inner element 852 and an outer element 850. The inner element 852 may provide the engagement section 114. Between the inner element 852 and the outer element 850, may be a series of round structures 854 that roll with very little resistance. Through the combination of the inner element 852, outer element 850, and round structures 854, multiple points for forming a virtual center of rotation may be defined, thus removing off-axis torque applications.

The bearing assemblies provided above may be used in combination with other embodiments provided above. Those skilled in the relevant art will appreciate that numerous combinations of wrenches 100 are described herein and no one illustration is self limiting.

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A torque wrench comprising:

a wrench head configured to grip a fastener and apply torque to rotate the fastener about a fastener axis when the fastener is gripped by the wrench head, and the wrench head defining a wrench head plane that is normal to the fastener axis when the fastener is gripped by the wrench head;

a handle;

a torque lever coupled to and extending from the wrench head toward the handle along a length of the torque wrench; and a torque application arm coupled to the handle and extending along the length of the torque wrench toward the wrench head, the torque lever and the torque application arm contacting each other at a contact point, wherein a force applied to the handle is transferred to the wrench head via the torque lever and the torque application arm at the contact point;

wherein the wrench head is hinged relative to a portion of the torque wrench including the handle, torque application arm, and torque lever, and the portion of the torque wrench including the handle, torque application arm, and torque lever is pivotable with respect to the wrench head plane, the torque wrench further comprising a linkage for coupling the torque lever to the wrench head, wherein pivoting of the portion of the torque wrench including the handle, torque application arm, and torque lever relative to the wrench head plane moves the contact point between the torque lever and the torque application arm.

2. The torque wrench of claim 1, wherein the linkage axially translates the torque lever along the length of the torque wrench responsive to the pivoting of the portion of the torque wrench including the handle, torque application arm, and torque lever relative to the wrench head plane.

3. The torque wrench of claim 1, wherein the linkage moves the contact point between the torque lever and the torque application arm towards the handle when the wrench head is pivoted from a first position in which the portion of the torque wrench including the handle, torque application arm, and torque lever is aligned with the wrench head plane to a second position in which the portion of the torque wrench including the handle, torque application arm, and torque lever is not aligned with the wrench head plane.

4. The torque wrench of claim 1, wherein the wrench is a click-type torque wrench.

5. A torque wrench comprising a wrench head configured to grip a fastener and apply torque to rotate the fastener about a fastener axis when the fastener is gripped by the wrench head, and the wrench head defining a wrench head plane that is normal to the fastener axis when the fastener is gripped by the wrench head;

a linkage having a first end coupled to the wrench head and a second end terminating in a torque lever, a portion of the torque wrench including the torque lever is pivotable relative to the wrench head plane; and a handle having an end that terminates in a torque application arm, the torque application arm and torque lever making contact at a point to transmit force from the handle to the wrench head, wherein the linkage moves the point at which the torque application arm and the torque lever make contact axially along a length of the torque wrench responsive to pivoting of the portion of the torque wrench including the torque lever with respect to the wrench head plane.

6. The torque wrench of claim 5, wherein the linkage axially translates the torque lever along the length of the torque wrench responsive to the pivoting of the portion of the torque wrench including the torque lever with respect to the wrench head plane.

7. A click-type torque wrench comprising a handle;

a torque application arm extending from the handle;

a wrench head configured to grip a fastener and apply torque to rotate the fastener about a fastener axis when the fastener is gripped by the wrench head, and the wrench head defining a wrench head plane that is normal to the fastener axis when the fastener is gripped by the wrench head, a portion of the torque wrench including the handle and the torque application arm is pivotable relative to a the wrench head plane between in plane and out of-plane positions;

a torque lever that makes contact with the torque application arm at a contact point, wherein a force applied to the handle is transferred to the wrench via the torque lever and the torque application arm at the contact point; and a linkage that couples the torque lever to the wrench head, the linkage translating the torque lever relative to the wrench head in response to pivoting of the portion of the torque wrench including the handle and the torque application arm with respect to the wrench head plane.

8. The torque wrench of claim 7, further comprising a drive structure; wherein the wrench head is pivotable relative to a first end of the drive structure, and the linkage extends through the drive structure.

9. The torque wrench of claim 7, wherein the linkage axially translates the torque lever along a length of the torque wrench responsive to the pivoting of the portion of the torque wrench including the handle and the torque application arm with respect to the wrench head plane.

10. The torque wrench of claim 7, wherein the linkage moves the contact point between the torque lever and the torque application arm towards the handle when the wrench head is pivoted from a first position in which the portion of the torque wrench including the handle and the torque application arm is aligned with the wrench head plane to a second position in which the portion of the torque wrench including the handle, and the torque application arm is not aligned with wrench head plane.

* * * * *